US011259368B2

(12) United States Patent
Roberts et al.

(10) Patent No.: US 11,259,368 B2
(45) Date of Patent: Feb. 22, 2022

(54) THIN-FILM HEATING DEVICE

(71) Applicant: DUPONT ELECTRONICS, INC., Wilmington, DE (US)

(72) Inventors: Kurt Douglas Roberts, Raleigh, NC (US); Jonathan A. Weldon, Durham, NC (US)

(73) Assignee: DUPONT ELECTRONICS, INC., Wilmington, DE (US)

( * ) Notice: Subject to any disclaimer, the term of this patent is extended or adjusted under 35 U.S.C. 154(b) by 266 days.

(21) Appl. No.: 15/656,521

(22) Filed: Jul. 21, 2017

(65) Prior Publication Data

US 2018/0027612 A1 Jan. 25, 2018

Related U.S. Application Data

(60) Provisional application No. 62/365,642, filed on Jul. 22, 2016.

(51) Int. Cl.
*H05B 3/03* (2006.01)
*H05B 3/14* (2006.01)
(Continued)

(52) U.S. Cl.
CPC ..... *H05B 3/03* (2013.01); *H05B 3/146* (2013.01); *H05B 3/267* (2013.01); *H05B 3/34* (2013.01);
(Continued)

(58) Field of Classification Search
CPC ..... H05B 3/00; H05B 3/0023; H05B 3/03; H05B 3/06; H05B 3/10; H05B 3/12; H05B 3/14; H05B 3/146; H05B 3/16; H05B 3/18; H05B 3/26; H05B 3/267; H05B 3/34; H05B 2203/007; H05B 2203/0011; H05B 2203/013; H05B 2203/023
(Continued)

(56) References Cited

U.S. PATENT DOCUMENTS 3,266,661 A * 8/1966 Dates ..... H01C 17/06 220/62.15
4,593,181 A 6/1986 Jensen et al.
(Continued)

FOREIGN PATENT DOCUMENTS

CN 1254932 5/2006
CN 102511066 6/2012
(Continued)

OTHER PUBLICATIONS

PCT International Search Report for Application No. PCT/US2017/041710, Garcia Congosto, M, Authorized Officer, ISA/EPO, dated Sep. 25, 2017.

*Primary Examiner* — Justin C Dodson

(57) ABSTRACT

A thin-film heating device includes a base layer, a bus bar layer and an electrode layer. The base layer includes a polymeric resistive layer, including conductive filler, in contact with a polymeric dielectric layer. The polymeric resistive layer has a sheet resistance in a range of from about 0.5 ohm/square to about 2 Megaohm/square. The bus bar layer is adhered to the polymeric dielectric layer of the base layer. The bus bar layer includes a first patterned conductive material. The electrode layer includes a second patterned conductive material and is electrically connected to the bus bar layer.

12 Claims, 2 Drawing Sheets

(51) Int. Cl.
*H05B 3/26* (2006.01)
*H05B 3/34* (2006.01)

(52) U.S. Cl.
CPC .. *H05B 2203/011* (2013.01); *H05B 2203/013* (2013.01)

(58) Field of Classification Search
USPC ..... 219/528, 541–544, 546, 548, 549, 553
See application file for complete search history.

(56) References Cited

U.S. PATENT DOCUMENTS 4,761,541 A 8/1988 Batliwalla et al.
4,777,351 A * 10/1988 Batliwalla ..... H01C 7/027 219/528
5,078,936 A 1/1992 Parish et al.
5,358,782 A * 10/1994 Parish ..... B32B 27/34 428/323
6,307,188 B1 * 10/2001 Bulgajewski ..... H05B 3/845 219/505
7,041,378 B2 * 5/2006 Van Der Woude .... H05B 3/146 428/447
7,053,344 B1 5/2006 Surjan et al.
7,265,324 B2 9/2007 Ozawa et al.
7,273,661 B2 9/2007 Moriyama et al.
7,348,373 B2 3/2008 Dueber et al.
8,263,202 B2 * 9/2012 Glenn ..... B32B 3/22 428/411.1
8,427,845 B2 4/2013 Gorczyca et al.
2006/0127686 A1 * 6/2006 Meloni ..... C08K 3/38 428/473.5
2007/0053168 A1 3/2007 Sayir et al.
2007/0221658 A1 * 9/2007 Cates ..... H05B 3/342 219/529
2009/0272731 A1 * 11/2009 Olding ..... C08L 71/00 219/482
2010/0038356 A1 * 2/2010 Fukuda ..... H01C 7/021 219/549
2010/0126981 A1 * 5/2010 Heintz ..... C08F 259/08 219/482
2010/0176118 A1 * 7/2010 Lee ..... H05B 3/34 219/549
2011/0229680 A1 * 9/2011 Glenn ..... B32B 15/20 428/68
2012/0138595 A1 * 6/2012 Watakabe ..... H05B 3/34 219/528
2012/0175362 A1 * 7/2012 Mikkelsen ..... H01C 7/021 219/553
2014/0086748 A1 3/2014 Peltola et al.
2016/0021705 A1 * 1/2016 Barfuss ..... H05B 3/34 219/553
2016/0183328 A1 6/2016 Pepin et al.

FOREIGN PATENT DOCUMENTS

CN 102481598 7/2014
CN 104419808 3/2015
CN 102812082 9/2015
CN 103642155 8/2016
CN 104685577 1/2018
EP 1996997 12/2008
EP 2125404 A1 12/2009
EP 2181015 B1 5/2012
WO 2007/109369 9/2007

* cited by examiner

THIN-FILM HEATING DEVICE

BACKGROUND INFORMATION

Field of the Disclosure

This disclosure relates to thin-film heating devices.

Description of the Related Art

Metal pastes have been used to create resistive heating elements supported by temperature resistant films. European Patent No. 2 181 015 discloses relatively thin heater devices useful in applications such as seats and steering wheels in automobiles. The heater device includes a polyimide dielectric substrate layer with a resistive layer of carbon-filled polyimide overlaying the substrate layer, and a conductor which acts as both an electrode and bus structure overlaying and in contact with the resistive layer. The electrodes and bus structure can be provided in the form of a metal paste, such as a printable conductive ink. U.S. Pat. No. 8,263,202 discloses film-based heating devices with a resistive polyimide base film containing electrically conductive filler, such as carbon black, adhered to metal foil bus bars using a conductive adhesive. By using metal foil as bus bars instead of metal paste, the voltage stability along the length of the bus bar is greatly improved but the adhesive system may limit performance. This film-based heating device may include a secondary base film of a dielectric material, such as polyimide.

Using printed metal pastes as conductors in thin-film heating devices presents several challenges. Non-uniformities in printing of the metal paste results in a conductor with variations in resistance both along the length of the conductor and across its width. These variations in resistance cause corresponding variations in current flow and non-uniform power densities in the conductor leading to localized heating (e.g., hot spots) in high power applications. In addition, as the size of the heating device is increased, longer conductors effectively magnify the non-uniformities along the length of the metal paste. Furthermore, since the printed metal paste is more resistive than traditional metals (e.g., copper), large power drops along the length of a long conductor can result in non-uniform heating along the length of the heating device.

While heating devices using metal pastes may be useful in small-scale applications in relatively hospitable environments at modest temperatures and with lower voltages, producing thin-film heating devices for larger applications with exposure to harsher environments is much more challenging. For example, deicing of rotor blades of wind turbines puts greater demands on the ability of a thin-film heating device to deliver uniform heat over a very large area in a thin, flexible, light-weight construction, while operating at higher voltages with greater power output.

SUMMARY

A thin-film heating device includes a base layer, a bus bar layer and an electrode layer. The base layer includes a polymeric resistive layer, including conductive filler, in contact with a polymeric dielectric layer. The polymeric resistive layer has a sheet resistance in a range of from about 0.5 ohm/square to about 2 Megaohm/square. The bus bar layer is adhered to the polymeric dielectric layer of the base layer. The bus bar layer includes a first patterned conductive material. The electrode layer includes a second patterned conductive material and is electrically connected to the bus bar layer. The foregoing general description and the following detailed description are exemplary and explanatory only and are not restrictive of the invention, as defined in the appended claims.

DETAILED DESCRIPTION

Figure 1:
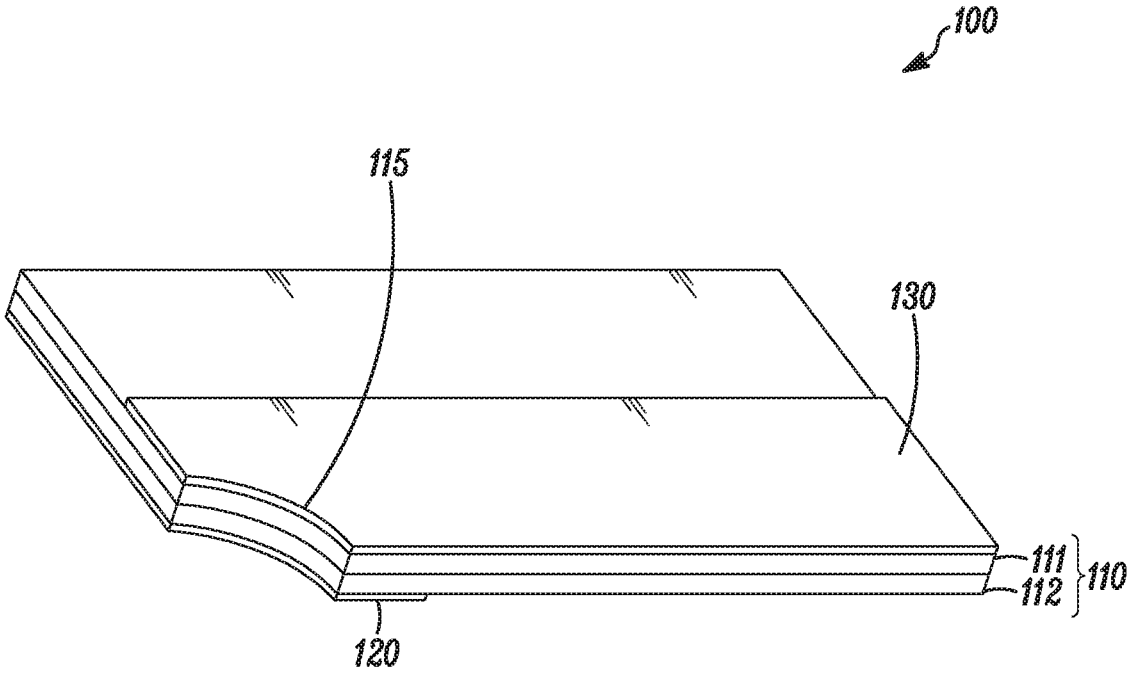
FIG. 1 is a fragmentary view of a portion one embodiment of a thin-film heating device where a via (shown cut away) is provided to enable electrical connection between a bus bar layer and an electrode layer.

A thin-film heating device includes a base layer, a bus bar layer and an electrode layer. The base layer includes a polymeric resistive layer, including conductive filler, in contact with a polymeric dielectric layer. The polymeric resistive layer has a sheet resistance in a range of from about 0.5 ohm/square to about 2 Megaohm/square. The bus bar layer is adhered to the polymeric dielectric layer of the base layer. The bus bar layer includes a first patterned conductive material. The electrode layer includes a second patterned conductive material and is electrically connected to the bus bar layer.

In one embodiment, the base layer further includes an array of vias that provide paths for electrical connection between the electrode layer and the bus bar layer.

In another embodiment, the polymeric resistive layer of the base layer includes a first polymeric dielectric material.

In yet another embodiment, the polymeric dielectric layer of the base layer includes a second polymeric dielectric material.

In still another embodiment, the bus bar layer further includes a third polymeric dielectric material. In a specific embodiment, the third polymeric dielectric material of the bus bar layer includes a polyimide.

In still yet another embodiment, the first patterned conductive material of the bus bar layer includes an electrically conductive paste or a metal.

In a further embodiment, the second patterned conductive material of the electrode layer includes an electrically conductive paste or a metal.

In yet a further embodiment, the second patterned conductive material of the electrode layer has a resistivity in a range of from about 4 to about 100 milliohm/square.

In still a further embodiment, the electrode layer includes a plurality of patterned electrodes.

In still yet a further embodiment, the thin-film heating device further includes an outer dielectric layer on one or both sides of the thin film heating device.

In another embodiment, the base layer has a thickness in a range of from about 2 to about 250 μm.

In still another embodiment, the electrode layer has a thickness in a range of from about 0.015 to about 250 μm.

In still yet another embodiment, the bus bar layer is adhered to the polymeric dielectric layer of the base layer via an adhesive layer.

Many aspects and embodiments have been described above and are merely exemplary and not limiting. After reading this specification, skilled artisans appreciate that other aspects and embodiments are possible without departing from the scope of the invention. Other features and advantages of the invention will be apparent from the following detailed description, and from the claims.

Definitions

The following definitions are used herein to further define and describe the disclosure.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

As used herein, the terms "a" and "an" include the concepts of "at least one" and "one or more than one".

Unless stated otherwise, all percentages, parts, ratios, etc., are by weight.

When the term "about" is used in describing a value or an end-point of a range, the disclosure should be understood to include the specific value or end-point referred to.

Base Layer

In one embodiment, a base layer for a thin-film heating devices includes a polymeric resistive layer in contact with a polymeric dielectric layer.

In one embodiment a polymeric resistive layer can include a first polymeric dielectric material. In one embodiment, a polymeric dielectric layer can include a first and a second polymeric dielectric material. The first and second polymeric dielectric materials can each include a polyimide, a tetrafluoroethylene hexafluoropropylene copolymer (FEP), a perfluoroalkoxy polymer (PFA), a polyvinyl fluoride (PVF), a polyvinylidene fluoride (PVDF), a polyester (such as polyethylene terephthalate (PET) or polyethylene naphthalate (PEN)), a polyether ether ketone (PEEK), a polycarbonate (PC) or a mixture thereof. In one embodiment, the first and second polymeric dielectric materials can be the same or different. In one embodiment, the polymeric resistive layer and the polymeric dielectric layer can each include a screen printed or photoimageable epoxy, a silicone, a filled epoxy, a filled silicone, or a mixture thereof.

In one embodiment, a polyimide can be an aromatic polyimide. In a specific embodiment, an aromatic polyimide can be derived from at least one aromatic dianhydride and at least one aromatic diamine. In some embodiments, the aromatic diamine is selected from the group consisting of 4,4'-diaminodiphenyl propane, 4,4'-diaminodiphenyl methane, benzidine, 2,2'bis(trifluoromethyl)benzidine, 2,2'-bis(4-aminophenyl) hexafluoropropane, 3,5-diaminobenzotrifluoride; diaminodurene, 3,3',5,5'-tetramethyl benzidine, 4,4'-diaminodiphenyl sulfide, 3,3'-diaminodiphenyl sulfone, 4,4'-diaminodiphenyl sulfone, 1,5-diamino-naphthalene; 1,4-diamino-naphthalene, 4,4'-diaminodiphenylsilane, 4,4'-diaminodiphenyl (phenyl phosphine oxide), 4,4'-diaminodiphenyl-N-phenyl amine, 3,4'-diamino phenylether; 1,4-bis(4-aminophenoxy)benzene, 1,3-bis(4-aminophenoxy)benzene; 4,4'-diaminobenzanilide, 4,4'-bis (4-aminophenoxy)biphenyl, 9,9'-bis(4-aminophenyl)fluorine, m-tolidine, o-tolidine, 3,3'dihydroxy-4,4'-diaminobiphenyl,1,4-diaminobenzene (p-phenylene-diamine), 1,3-diaminobenzene (p-phenylene-diamine), 1,2-diaminobenzene and mixtures thereof.

In some embodiments, the aromatic dianhydride is selected from the group consisting of 2,3,6,7-naphthalene tetracarboxylic dianhydride, 3,3',4,4'-biphenyl tetracarboxylic dianhydride, 1,2,5,6-naphthalene tetracarboxylic dianhydride, 2,2'3,3'-biphenyl tetracarboxylic dianhydride, 2,3',3,4'-biphenyl tetracarboxylic dianhydride, 3,3'4,4'-benzophenone tetracarboxylic dianhydride, 2,2-bis-(3,4-dicarboxyphenyl) propane dianhydride, bis (3,4-dicarboxyphenyl) sulfone dianhydride, 3,4,9,10-perylene tetracarboxylic dianhydride, 1,1-bis (3,4-dicarboxyphenyl) ethane dianhydride, bis-(3,4-dicarboxyphenyl) methane dianhydride, 4,4'-oxydiphthalic dianhydride, bis (3,4dicarboxyphenyl) sulfone dianhydride, 2,2-bis(3,4-dicarboxyphenyl), hexafluoropropane dianhydride; bis(3,4-dicarboxyphenyl)sulfide; hydroquinone, diphthalic anhydride and mixtures thereof. In some embodiments, at least 70 mole percent of the aromatic polyimide is derived from pyromellitic dianhydride and 4,4'-diaminodiphenyl ether. In some embodiments, the aromatic polyimide is derived from pyromellitic dianhydride and 4,4'-diaminodiphenyl ether. In one embodiment, the polyimide material of the resistive layer and the polyimide material of the dielectric layer can be the same or different.

In one embodiment, the polymeric resistive layer includes electrically conductive filler in a range of from about 10 to about 45 weight percent based upon the total weight of the polymeric resistive layer. In a specific embodiment, the electrically conductive filler is present in a range of from about 15 to about 40 weight percent based upon the total weight of the polymeric resistive layer. In a more specific embodiment, the electrically conductive filler is present in a range of from about 20 to about 35 weight percent based upon the total weight of the polymeric resistive layer. In some embodiments, the electrically conductive filler is carbon black. In some embodiments, the electrically conductive filler is selected from the group consisting of acetylene blacks, super abrasion furnace blacks, conductive furnace blacks, conductive channel type blacks and fine thermal blacks and mixtures thereof. Surface oxidation of carbon black, which is typically measured by volatile content, refers to various oxygenated species (such as carboxyl, hydroxyl, quinone) present on the surface of the aggregates. While these species are present to some extent in all carbon blacks, some blacks are post-treated to intentionally increase the amount of surface oxidation. The oxygen complexes on the surface act as an electrically insulating layer. Thus, low volatility content is generally desired for high conductivity. However, it is also necessary to consider the difficulty of dispersing the carbon black. Even dispersion of the electrically conductive filler facilitates even heating of thin-film heating device. Surface oxidation enhances deagglomeration and dispersion of carbon black. In some embodiments, when the electrically conductive filler is carbon black, the carbon black has a volatile content less than or equal to 1%. In one embodiment, the carbon black is RAVEN® 16 (available from Columbian Chemicals Co., Inc., Marietta, Ga.), in another embodiment, the carbon black is CDX 7055U (available from Columbian Chemicals). In some embodiments, the electrically conductive filler has an electrical resistance of at least 100 ohm/square. In some embodiments, the electrically conductive filler has an electrical resistance of at least 1000 ohm/square. In another embodiment, the electrically conductive filler has an electrical resistance of at least 10,000 ohm/square. In some embodiments, the electrically conductive filler is metal or metal alloy. In some embodiments, the electrically conductive filler is a mixture of electrically conductive fillers. In some embodiments, the electrically conductive filler is milled to obtain desired agglomerate size (particle size). In one embodiment, the average particle size of the electrically conductive filler is in a range of from about 0.05 to about 1 μm. The average particle size can be determined using a Horiba Light Scattering Particle Size Analyzer (Horiba, Inc., Japan). In one embodiment, the average particle size of the electrically conductive filler is in a range of from about 0.1 to about 0.5 μm. Generally, an average particle size above 1 μm is more likely to cause electrical shorts and/or hot spots. In one embodiment, the electrically conductive filler particle size is less than or equal to 1 μm. Ordinary skill and experimentation may be necessary in fine tuning the type and amount of electrically conductive filler sufficient to achieve desired resistance depending upon the particular application. In one embodiment, the polymeric resistive layer includes a polyimide material with electrically conductive filler and has a sheet resistance in a range of from about 0.5 ohm/square to about 2 Megaohm/square measured using an FPP5000 four point probe (Veeco Instruments, Inc., Somerset, N.J.). In one embodiment, the polymeric resistive layer has a sheet resistance in a range of from about 2 ohm/square to about 10,000 ohm/square. In a specific embodiment, the polymeric resistive layer has a sheet resistance in a range of from about 10 to about 500 ohm/square. In a more specific embodiment, the polymeric resistive layer has a sheet resistance in a range of from about 50 to about 150 ohm/square.

In one embodiments, the base layer optionally includes a non-electrically conductive filler in either the polymeric resistive layer, the polymeric dielectric layer or both. Non-electrically conductive fillers may be included to improve, thermal conductivity, mechanical properties, etc. In some embodiments, a non-electrically conductive filler is selected from the group consisting of metal oxides, carbides, borides and nitrides. In a specific embodiment, the non-electrically conductive filler is selected from the group consisting of aluminum oxide, titanium dioxide, silica, mica, talc, barium titanate, barium sulfate, dicalcium phosphate, and mixtures thereof.

In one embodiment, the base layer further includes an array of electrically conductive vias, or openings, in the base layer, that provide the electrical connection between the electrode layer and the bus bar layer. Conductive vias can be through-hole, blind, or buried and can be plated or filled with conductive material that is either sintered or cured. Conductive materials can include conductive metals, conductive pastes, conductive inks or any other conductive material commonly used in printed circuit board manufacture. In one embodiment, vias may be filled with a conductive material selected from a variety of electrically conductive inks or pastes, such as DuPont CB Series screen printed ink materials, DuPont 5025 silver conductor and DuPont™ Kapton™ KA801 polyimide silver conductor (all available from DuPont Microcircuit Materials, Research Triangle Park, N.C.).

In one embodiment, the base layer has a thickness in a range of from about 2 to about 250 μm. In a specific embodiment, the base layer has a thickness in a range of from about 10 to about 150 μm. In a more specific embodiment, the base layer has a thickness in a range of from about 25 to about 75 μm. In one embodiment, the polymeric resistive layer has a thickness in the range of from about 10 to about 100 μm. In a specific embodiment, the polymeric resistive layer has a thickness in the range of from about 10 to about 50 μm. In one embodiment, the polymeric dielectric layer has a thickness in the range of from about 10 to about 100 μm. In a specific embodiment, the polymeric dielectric layer has a thickness in the range of from about 10 to about 50 μm. In one embodiment, the polymeric resistive layer and the polymeric dielectric layer may be coextruded to form the base layer. In one embodiment, a base layer can be a Kapton® 200RS100 polyimide film (available from E.I. du Pont de Nemours and Co., Wilmington, Del.).

Bus Bar Layer

In one embodiment, a bus bar layer for a thin-film heating device includes a first patterned conductive material (e.g., an electrically conductive paste, a metal, etc.) that is adhered to the polymeric dielectric layer of the base layer. In one embodiment, the first patterned conductive material is a highly conductive material (e.g., copper, silver, gold, etc.) that enable electrical current to be efficiently and uniformly delivered to the thin-film heating device. In one embodiment, a bus bar layer includes a metal foil, either standalone or adhered to a dielectric material, with a metal foil thickness of from about 18 to about 140 μm (i.e., 0.5 oz. to 4 oz. metal foil) and a minimum dielectric thickness of 12.5 to 75 μm. A patterned trace can be designed to optimize the uniformity of the current being delivered to the thin-film heating device. For example, the patterned trace can have a minimum 200 μm pitch with equal 100 μm line widths and spaces and a maximum pitch equal to the size of the largest overall heater dimension.

In one embodiment, the bus bar layer includes a third polymeric dielectric material. The third polymeric dielectric material may provide mechanical support for the first patterned conductive material, as well as electrically insulating the first patterned conductive material from unwanted electrical connections. The third polymeric dielectric material can include any of the dielectric materials described above for the first and second polymeric dielectric materials, and can be the same or different as one or both of the first and second polymeric dielectric materials.

In one embodiment, the bus bar layer for a thin-film heating device can be adhered to the polymeric dielectric layer of the base layer via an adhesive layer. In one embodiment, an adhesive layer can include a thermally cured adhesive, such as an acrylic adhesive (e.g., Pyralux® LF adhesive, DuPont, which can be cure at 150-180° C. and 150 psi) or a thermoplastic adhesive (e.g., Pyralux® HT bonding film, DuPont, which cures at high temperature and pressure, upwards of 350° C. and 450 psi). In one embodiment, an epoxy adhesive or a pressure sensitive acrylic adhesive may be used.

Electrode Layer

In one embodiment, an electrode layer for a thin-film heating device includes a second patterned conductive material (e.g., an electrically conductive paste, a metal, etc.) that is adhered to the polymeric resistive layer of the base layer.

In one embodiment, the second patterned conductive material can be an electrically conductive paste. In one embodiment, the electrically conductive paste can include a polyimide polymer represented by formula I:

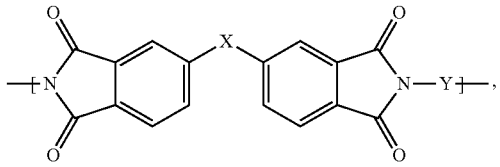

I wherein X is $C(CH3)_2$, O, $SO_2$ or $C(CF_3)_2$, O—Ph—$C(CH_3)_2$—Ph—O, O—Ph—O— or a mixture of two, or more of $C(CH_3)_2$, O, $SO_2$, and $C(CF_3)_2$, O—Ph—$C(CH_3)_2$—Ph—O, O—Ph—O—;

wherein Y is diamine component or mixture of diamine components selected from the group consisting of:

m-phenylenediamine (MPD), 3,4'-diaminodiphenyl ether (3,4'-ODA), 4,4'-diamino-2,2'-bis(trifluoromethyl)biphenyl (TFMB), 3,3'-diaminodiphenyl sulfone (3,3'-DDS), 4,4'-(Hexafluoroisopropylidene)bis(2-aminophenol) (6F-AP) bis-(4-(4-aminophenoxy)phenyl)sulfone (BAPS) and 9,9-bis(4-aminophenyl)fluorene (FDA); 2,3,5,6-tetramethyl-1,4-phenylenediamine (DAM), 2,2-bis[4-(4-aminophenoxyphenyl)]propane (BAPP), 2,2-bis[4-(4-aminophenoxyphenyl)] hexafluoropropane (HFBAPP), 1,3-bis(3-aminophenoxy) benzene (APB-133), 2,2-bis(3-aminophenyl)hexafluoropropane, 2,2-bis(4 aminophenyl) hexafluoropropane (Bis-A-AF), 4,4'-bis(4-amino-2-trifluoromethylphenoxy) biphenyl, 4,4'-[1,3-phenylenebis(1-methyl-ethylidene)] bisaniline (Bisaniline-M) with the proviso that:

i. if X is O, then Y is not m-phenylenediamine (MPD), bis-(4-(4-aminophenoxy)phenyl)sulfone (BAPS) and 3,4'-diaminodiphenyl ether (3,4'-ODA); BAPP, APB-133, Bisaniline-M;

ii. if X is $SO_2$, then Y is not 3,3'-diaminodiphenyl sulfone (3,3'-DDS);

iii. if X is $C(CF_3)_2$, then Y is not m-phenylenediamine (MPD), bis-(4-(4-aminophenoxy)phenyl)sulfone (BAPS), 9,9-bis(4-aminophenyl)fluorene (FDA), and 3,3'-diaminodiphenyl sulfone (3,3'-DDS);

iv. if X is O—Ph—$C(CH_3)_2$—Ph—O or O—Ph—O—, then Y is not m-phenylene diamine (MPD), FDA, 3,4'-ODA, DAM, BAPP, APB-133, bisaniline-M.

This paste is advantageous in that it contains solvents which are not based on the typical DMAC or NMP solvents normally used with polyimides, but based on solvents which are more amenable to screen printing, having less toxicity and better handling, viscosity and drying processing windows for routine screen printing. Because this conductive paste is based on polyimide chemistry, it is also thermally stable after printing and drying and enables good electrical connection to the polymeric resistive layer of the base layer, such that an electrode layer for a thin-film heating device that can operate at high-temperature can be made.

In one embodiment, conductive metal powder, such as silver, in an organic solution of a solvent soluble polyimide can form an electrically conductive paste which is amenable to screen printing. Useful solvents include dipropylene glycol methyl ether (DOWANOL™ DPM, Dow Chemical Co., Midland, Mich.), propylene glycol methyl ether acetate (DOWANOL™ PMA, Dow Chemical), di-basic esters, lactam ides, acetates, diethyl adipate, texanol, glycol ethers, carbitols, and the like. Such solvents can dissolve the solvent-soluble polyimide resin and render a solution to which Ag and other electrically conductive metal powders can be dispersed, rendering a screen-printable paste composition. Solution of the polyimide resin in the selected solvents is possible through the selection of the monomers used to make the polyimide. In some embodiments, metals other than Ag, such as Ni, Cu, Pt, Pd and the like, and powders of various morphologies and combinations of those morphologies may be used.

In one embodiment, the electrically conductive paste can be printed to a thickness of 10 to 15 μm wet on the polymeric resistive layer of the base layer, then dried at 130° C. in air for 10 minutes then dried again at 200° C. for 10 minutes. The size and placement of the electrodes of the electrically conductive paste can be chosen based on the resistivity of the polymeric resistive layer at the desired operating temperature and voltage of the thin-film heating device, and the overall size of the thin-film heating device. In a particular embodiment, the operating temperature may be about 200° C. and the voltage may be 220 V.

In one embodiment, the second patterned conductive material can be a metal (e.g., Al, Cu, Ag, Au, Ni, etc.), a metal alloy (e.g., CrNi, CuNi, etc.) or a metal oxide (e.g., AlO2, ITO, IZO, etc.).

In one embodiment, the electrode layer has a thickness in the range of from about 0.155 to about 250 μm. In a specific embodiment, when the second patterned conductive material is an electrically conductive paste, the polymeric dielectric layer has a thickness in the range of from about 5 to about 250 μm, or from about 5 to about 50 μm. In one embodiment, the electrically conductive paste in the electrode layer includes Ag powder in a range of from about 40 to about 80 wt % based on the total weight of the dried paste, and has a dry thickness in a range of from about 5 to about 40 μm, resulting in an electrical resistivity in a range of from about 4 to about 100 milliohm/square.

Other Layers

In one embodiment, a thin-film heating device may include an outer dielectric layer on one or both sides of the thin-film heating device. The outer dielectric layer can act as a barrier layer, preventing environmental degradation of the thin-film heating device and preventing unwanted electrical current leakage from the device. In one embodiment, an outer dielectric layer can include a polymeric material, such as a polyimide, a tetrafluoroethylene hexafluoropropylene copolymer (FEP), a perfluoroalkoxy polymer (PFA) or a mixture thereof. Examples of polymeric outer dielectric layers include Pyralux® LF and Pyralux® LG (both available from DuPont) and Teflon® FEP and Teflon® PFA (both available from Chemours). In one embodiment, a polymeric material for an outer dielectric layer can include polyvinyl fluoride, polyvinylidene fluoride, polyester (such as polyethylene terephthalate or polyethylene naphthalate), polyether ether ketone, polycarbonate and mixtures thereof. In one embodiment, the outer dielectric layer can include a screen printed or photoimageable epoxy, silicone, filled epoxy, or filled silicone. Examples include FR-4203 (Asahi Rubber) and Pyralux® PC Photoimageable Coverlay (DuPont).

In one embodiment, an outer dielectric layer can be nip or press laminated directly onto the thin-film heating device. In one embodiment, an outer dielectric layer may have a thickness in a range of from about 10 to about 150 μm. In a specific embodiment, an outer dielectric layer may have a thickness in a range of from about 15 to about 75 μm.

Thin-Film Heating Device

Figure 2:
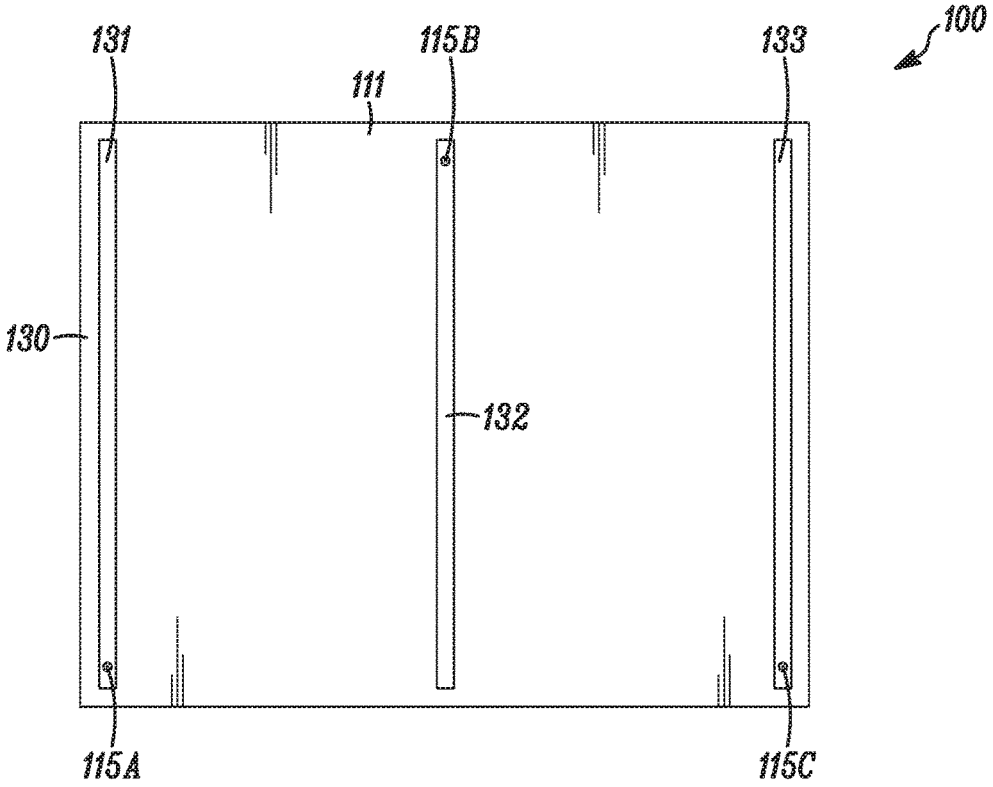
FIG. 2 is a plan view of one embodiment of a thin-film heating device showing a side of a base layer with a polymeric resistive layer and electrodes forming an electrode layer.
Figure 3:
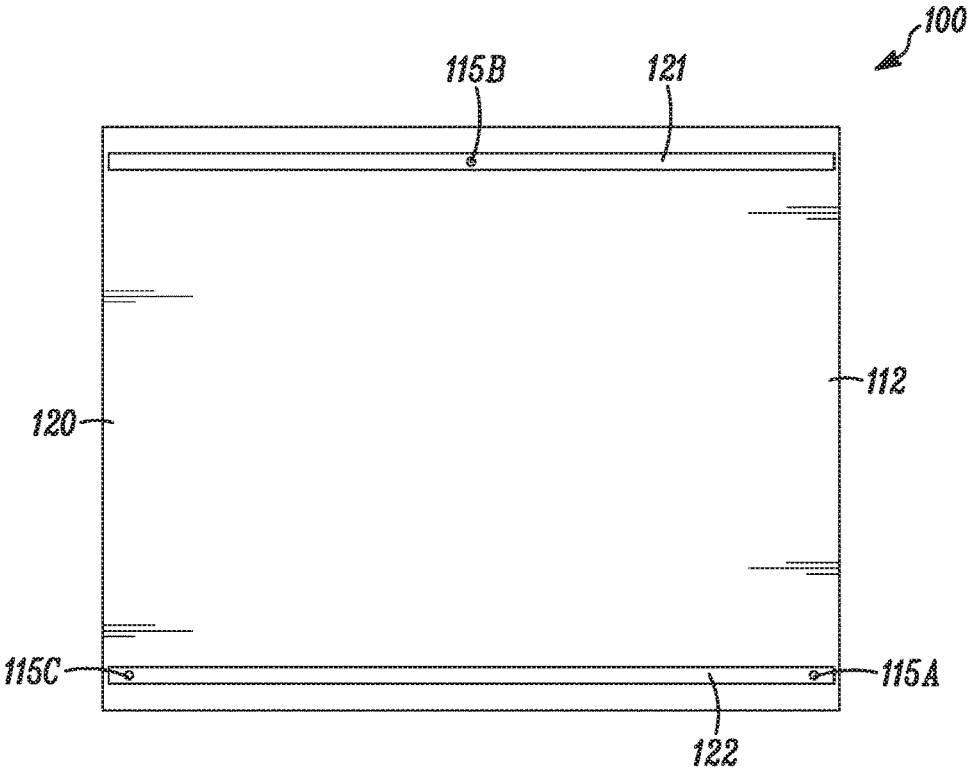
FIG. 3 is a plan view of one embodiment of a thin-film heating device, showing a side of a base layer with a polymeric dielectric layer and bus bars forming a bus bar layer.

FIG. 1 shows a fragmentary view of a portion of a thin-film heating device 100 near a via 115 (shown cut away) and includes a base layer 110, including a polymeric resistive layer 111 in contact with a polymeric dielectric layer 112. The via holes, or openings, for each layer can be made using a conventional process, such as drilling or punching. A bus bar layer 120 is formed by patterning a first conductive material using a conventional additive or subtractive processes. The bus bar layer 120 can be sputter deposited onto the polymeric dielectric layer 112 of the base layer 110 and patterned, providing a bus bar layer 120 adhered to the base layer 110 with unfilled vias 115, or openings. An electrode layer 130 can then be formed on the polymeric resistive layer 111 of the base layer 110 using an additive or subtractive process. In one embodiment, the electrode layer 130 is formed by pattering a second conductive material (e.g., screen printing a conductive silver paste). The second patterned conductive material can both form patterned electrodes for the electrode layer 130 and fill in the vias 115 of the base layer, providing intimate electrical contact between the electrode layer 130 and the bus bar layer 110 (not shown). Alternatively, the vias 115 can be filled with a conductive material (not shown) before forming the electrode layer 130. After patterning, the conductive material of the electrode layer is cured (e.g., thermally cured, UV cured, etc.). This will create the complete electrical circuit allowing current to flow through the polymeric resistive layer 111 of the thin-film heating device 100. FIG. 2 is a plan view of one embodiment of the thin-film heating device 100, showing a polymeric resistive layer 111 with electrodes 131, 132 and 133 forming electrode layer 130. The location of vias are represented by 115A, 115B and 115C. FIG. 3 is a plan view of the opposite side of the thin-film heating device 100, showing a polymeric dielectric layer 112 with bus bars 121 and 122 forming bus bar layer 120. The location of vias are represented by 115A, 115B and 115C. Once the curing process is completed, an outer dielectric layer (not shown) can be adhered to one or both sides of the thin-film heating device 100 with sheet adhesive. The outer dielectric layer can have holes, or openings, that correspond to the appropriate connection points on the patterned bus bar layer 110. The only exposed conductor remaining is that of the bus bar layer 110 where it intentionally interfaces with a connector or solder point. One skilled in the art will appreciate that the number of electrodes in the electrode layer, and their dimensions, can be modified to deliver the desired heat output of a thin-film heating device along with the desired temperature uniformity of the device. Furthermore, the number and location of vias can be modified to optimize the performance of the thin-film heating device.

In another embodiment, the electrode layer is formed by sputter deposition of a metal and subsequent plating of the metallic layer to achieve the desired metal thickness. The resulting metallic layer can then be patterned to form electrodes using subtractive methods common to printed circuit board manufacturing.

The thin-film heating device of the present disclosure is directed to high-voltage, high-temperature applications. The thin-film heating device of the present disclosure also provides even heating over large surfaces. In one embodiment, a large surface area heater utilizes roll format materials to construct a single heater that is 48 inches wide and 90 feet long, for a total surface area of 360 square feet. The bus bar layer allows for connectivity of the heater to a 600 volt power source with a continuous current draw of 20 amps without degradation to the performance (e.g. uniformity, power density). The bus bar structure allows operation in high voltage and high current designs due to the uniform thickness and increased conductivity of the metal foils. The design can be adjusted to a maximum length and width of the constituent materials (e.g. 48 inches wide by 2.5 miles long) and still perform properly. The limiting factor is metal foil thickness and length, based on power requirements. Larger heaters operating at high power densities will require very large amounts of current and will require the bus bar layer to be substantial enough in equivalent wire gauge to appropriately manage the power. This is a distinct improvement over prior thin-film heaters where the bus structure existed on the surface of the polymeric resistive layer. The limitations of printed inks and other adhesive conductors degrade the performance of these prior devices in high power or large area applications.

In one embodiment, a small area heater of approximately 3.5 square inches operating at 12 to 15 volts with 160 watts of power will draw between 10 to 13 amps of current. The bus bar layer is constructed to carry power to several electrodes which individually only receive a portion of the current. The bus bar layer is constructed with the appropriate copper thickness and line width to match the wire gauge necessary to safely carry 13 amps of current. Additionally, in this embodiment, a benefit is realized by not having the bus structure on the polymeric resistive layer. The bus structure material on the surface of the polymeric resistive layer impedes adhesion to the surfaces and devices being heated. This limitation to adhesion increases thermal resistance, thus limiting the maximum power density of such heating devices. Furthermore, the structure of the current thin-film heating device allows for the heater surface to match exactly the physical dimensions of the device to be heated, whereas prior devices require additional space to accommodate the bus structure and would not meet design requirements.

In one embodiment, a thin-film heating device is capable of continuous operation at a minimum temperature of approximately −60° C. and a maximum temperature of approximately 210° C., with shorter term peaks of 225 to 240° C. possible without damaging the heating device.

Thin-film heating devices of the present disclosure may be used for flexible or rigid applications and are particularly suited for high-voltage, high-temperature applications over large areas, such as windmill blades, leading edges of aircraft wings and helicopter blades, where the prevention of snow and/or ice accumulation is desired. While high-voltage, high-temperature applications are particularly well suited for the thin-film heating device of the present disclosure, one of skill in the art could envision using these thin-film heating devices for other heating applications, such as low-voltage, low-temperature applications, low-voltage, high-temperature applications and high-voltage, low-temperature applications.

Note that not all of the activities described above in the general description or the examples are required, that a portion of a specific activity may not be required, and one or more further activities may be performed in addition to those described. Still further, the order in which activities are listed are not necessarily the order in which they are performed. After reading this specification, skilled artisans will be capable of determining what activities can be used for their specific needs or desires.

In the foregoing specification, the invention has been described with reference to specific embodiments. However, one of ordinary skill in the art appreciates that one or more modifications or one or more other changes can be made without departing from the scope of the invention as set forth in the claims below. Accordingly, the specification and figures are to be regarded in an illustrative rather than a restrictive sense and any and all such modifications and other changes are intended to be included within the scope of invention.

Any one or more benefits, one or more other advantages, one or more solutions to one or more problems, or any combination thereof has been described above with regard to one or more specific embodiments. However, the benefit(s), advantage(s), solution(s) to problem(s), or any element(s) that may cause any benefit, advantage, or solution to occur or become more pronounced is not to be construed as a critical, required, or essential feature or element of any or all of the claims.

It is to be appreciated that certain features of the invention which are, for clarity, described above and below in the context of separate embodiments, may also be provided in combination in a single embodiment. Conversely, various features of the invention that are, for brevity, described in the context of a single embodiment, may also be provided separately or in any sub-combination. Further, references to values stated in ranges include each and every value within that range.

What is claimed is:

1. A thin-film heating device comprising:

a base layer comprising polymeric resistive layer in contact with a polymeric dielectric layer, wherein:

the polymeric resistive layer comprises a first polymeric dielectric material and from 15 and 40 weight percent of a conductive filler based upon the total weight of the polymeric resistive layer, wherein the first polymeric dielectric material comprises an aromatic polyimide; and the polymeric resistive layer has a sheet resistance in a range of from 50 to 150 ohm/square and a thickness in the range of from 10 to 50 μm;

a bus bar layer adhered to the polymeric dielectric layer of the base layer, such that the polymeric dielectric layer is disposed directly between the bus bar layer and the polymeric resistive layer, wherein the bus bar layer comprises a first patterned conductive material; and an electrode layer adhered to the polymeric resistive layer of the base layer, wherein the electrode layer comprises a second patterned conductive material and is electrically connected to the bus bar layer.

2. The thin-film heating device of claim 1, wherein the base layer further comprises an array of vias that provide paths for electrical connection between the electrode layer and the bus bar layer.

3. The thin-film heating device of claim 1, wherein the polymeric dielectric layer of the base layer comprises a second polymeric dielectric material.

4. The thin-film heating device of claim 3, wherein the bus bar layer further comprises a third polymeric dielectric material.

5. The thin-film heating device of claim 4, wherein the third polymeric dielectric material of the bus bar layer comprises a polyimide.

6. The thin-film heating device of claim 1, wherein the first patterned conductive material of the bus bar layer comprises an electrically conductive paste or a metal.

7. The thin-film heating device of claim 1, wherein the second patterned conductive material of the electrode layer comprises an electrically conductive paste or a metal.

8. The thin-film heating device of claim 1, wherein the second patterned conductive material of the electrode layer has a resistivity in a range of from about 4 to about 100 milliohm/square.

9. The thin-film heating device of claim 1, wherein the electrode layer comprises a plurality of patterned electrodes.

10. The thin-film heating device of claim 1, wherein the base layer has a thickness in a range of from 25 to 75 μm.

11. The thin-film heating device of claim 1, wherein the electrode layer has a thickness in a range of from 0.015 to 250 μm.

12. The thin-film heating device of claim 1, wherein the bus bar layer is adhered to the polymeric dielectric layer of the base layer via an adhesive layer.

* * * * *